US006328584B1

(12) United States Patent
Follett

(10) Patent No.: US 6,328,584 B1
(45) Date of Patent: Dec. 11, 2001

(54) SPLIT CIRCUIT 120/240 VOLT ADAPTER

(76) Inventor: R. R. Brad Follett, 712 West Chestermere Dr., Chestermere, Alberta (CA), T1X 1B5

( * ) Notice: Subject to any disclaimer, the term of this patent is extended or adjusted under 35 U.S.C. 154(b) by 0 days.

(21) Appl. No.: 09/713,058

(22) Filed: Nov. 16, 2000

(51) Int. Cl.[7] ..... H01R 27/00
(52) U.S. Cl. ..... 439/222
(58) Field of Search ..... 439/222, 107, 439/956, 170, 488, 491; 307/80, 77, 20

(56) References Cited

U.S. PATENT DOCUMENTS 3,812,445 * 5/1974 Stefani ..... 339/32 R
3,938,068 * 2/1976 Hagan ..... 337/189
4,725,240 * 2/1988 Braverman ..... 439/105
5,302,857 * 4/1994 Charles et al. ..... 307/20
5,397,929 * 3/1995 Hogarth et al. ..... 307/140
5,474,464 * 12/1995 Drewnicki ..... 439/172
5,660,554 * 8/1997 Mead ..... 439/172
5,821,636 * 10/1998 Baker et al. ..... 307/70
5,835,326 * 11/1998 Callaway ..... 361/11

* cited by examiner

*Primary Examiner*—Gary Paumen
*Assistant Examiner*—P. Nguyen

(57) ABSTRACT

An electrical adapter for use with a kitchen split/multiple circuit duplex wall receptacle, including an indicator light to identify the split/multiple circuit and including one 240 volt 15 amp NEMA 6-15R outlet and two 120 volt 15 amp NEMA 5-15R outlets and for use with a single 240 volt European appliance with power requirements up to 3000 watts or two 120 volt North American appliances with power requirements up to 1500 watts.

10 Claims, 2 Drawing Sheets

SPLIT CIRCUIT 120/240 VOLT ADAPTER

BACKGROUND OF THE INVENTION

This invention relates to an improved electrical adapter to be used with a split/multiple circuit duplex receptacle and provide firstly a single 240 volt 15 amp circuit outlet as well as two 120 volt 15 amp circuit outlets.

Commonly found in residential and commercial kitchens in North America, the split/multiple circuit duplex receptacle provides power for up to two separate appliances which consume large amounts of power, such as deep fryers, electrical kettles, griddles, broilers and ovens, each having 120 volt power requirements of up to 1500 watts. Current Canadian electrical codes require that all kitchen counter outlets be split/multiple circuit duplex wall receptacles and further that the two circuits of a split/multiple receptacle be 180 degrees out of phase and therefore have a voltage potential of 240 volts. Split/multiple circuit duplex receptacles are optional on kitchen countertops across the US.

Conventionally, kitchen appliances in North America are designed for use with 120 volt 15 amp alternating current outlets that are configured as per the North American Standard 120 volt 15 amp "NEMA 5-15R" receptacles and utilise a 2 or 3 pronged male plug configured as per the North American Standard 120 volt 15 amp "NEMA 5-15P" plugs (2 vertical parallel prongs and 1 round). Certain appliances, such as those mentioned above, can underperform at wattages limited conventionally to 1500 watts and could benefit substantially in their operation by an increase in power to between 1500 and 3000 watts. European kitchen appliances are designed for use with 240 volt alternating current and certain appliances such as those mentioned above have power requirements of up to 3000 watts. Power can be supplied to these European appliances by utilizing a 2 or 3 pronged male plug configured as per the North American Standard 240 volt 15 amp "NEMA 6-15P" plugs (2 horizontal inline prongs and 1 round).

An adapter, having 6 male prongs comprising 2 sets of NEMA 5-15P configured prongs, can, when plugged into both halves of a split/multiple circuit duplex receptacle, supply both of the circuits (180 degrees out of phase) to one single 240 volt 15 amp NEMA 6-15R receptacle. A split/multiple circuit indicator light incorporated into the adapter can visually distinguish between single and split/multiple circuit household duplex receptacles, which are unindentifiable otherwise.

Need has existed arising from the requirements for flexibility in outlet voltages for either 120 volts or 240 volts, without altering the household wiring connected to the split circuit duplex wall receptacle, and to accommodate this need, prior art teachings, such as Canadian Patent Application by Ollenberger CA2002984 (abandoned) dated Nov. 15, 1989, have described an adapter to be used with a split circuit receptacle and provides a single 240 volt 15 amp outlet with an indicator light to identify the type of duplex receptacle being used.

One of the improvements comprised in the present invention is two additional 120 volt 15 amp NEMA 5-15R receptacles on the adapter that can be used in the event the 240 volt receptacle is not in use. This is a significant improvement and benefit to the adapter as it allows for the use of both 240 volt and 120 volt appliances on the kitchen counter without the need for the removal of the adapter from the wall receptacle.

BRIEF DESCRIPTION OF THE INVENTION

Accordingly, it is the principle objective of this invention to provide an electrical adapter that, when used in combination with a common split/multiple circuit duplex receptacle, will provide a 240 volt 15 amp circuit to a NEMA 6-15R outlet for use with any European style 240 volt appliance with power requirements up to 3000 watts.

It is also another objective of this invention to provide an adapter that, when used in combination with a common split/multiple circuit duplex receptacle, will provide two 120 volt 15 amp circuits to two NEMA 5-15R receptacles only when the 240 volt 15 amp NEMA 6-15R outlet is not in use.

It is a further objective of this invention to provide an electrical adapter with visual indication means, such as an indicator light, to distinguish between split/multiple circuit and single circuit kitchen duplex receptacles.

BRIEF DESCRIPTION OF THE DRAWINGS

Similar numerals of reference designate corresponding parts in the drawings.

DESCRIPTION OF THE PREFERRED EMBODIMENTS

Figure 1:
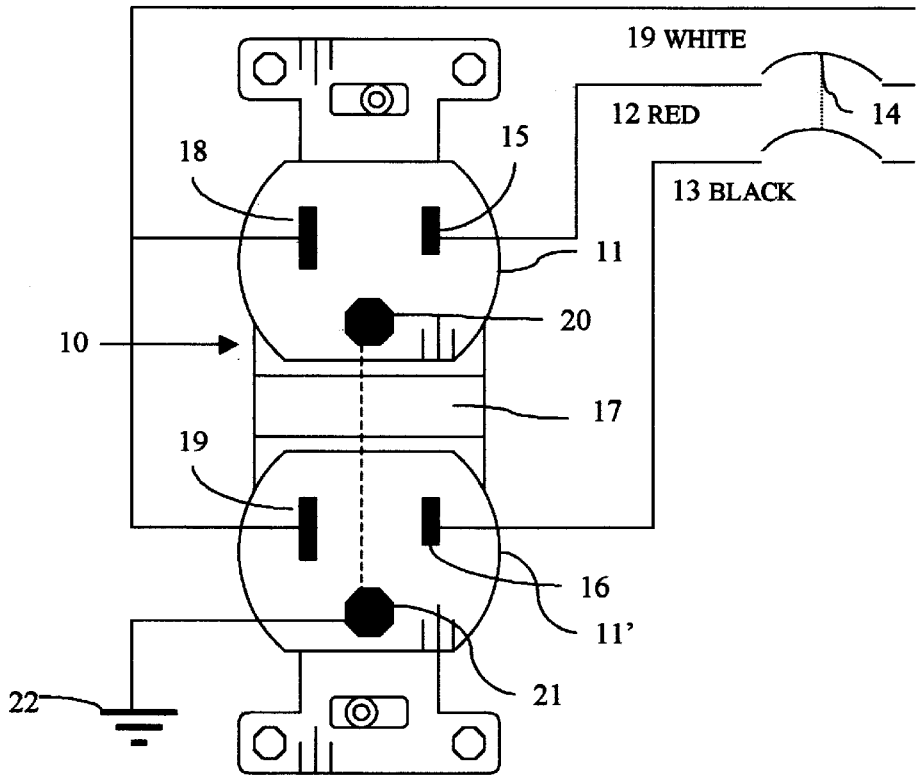
FIG. 1 is a schematic of a split/multiple circuit of a type in common use in residences for connection to duplex wall receptacles.

Referring to the drawings and with particular reference to FIG. 1, a schematic showing of a split/multiple wire circuit of a type conventionally available in modern residential kitchen construction is depicted, in which a grounded duplex electrical receptacle 10, comprising a pair of outlets 11 and 11', to which are connected, respectively, hot leads 12 and 13 designated respectively as "red" and "black", and connected to the power supply through a double pole single throw 240 volt breaker 14. Female connectors 15 and 16 are positioned in the insulated housing 17 at opposite ends, as depicted in FIG. 1 to which the hot leads 12 and 13 are connected. Neutral connectors 18 and 19 are spatially aligned conventionally with hot wire connectors 15 and 16 and are connected in parallel to a neutral lead 19, designated "white" in FIG. 1. Grounding connectors 20 and 21 centred on the housing 17, are electrically connected to ground 22, FIG. 1.

Figure 2:
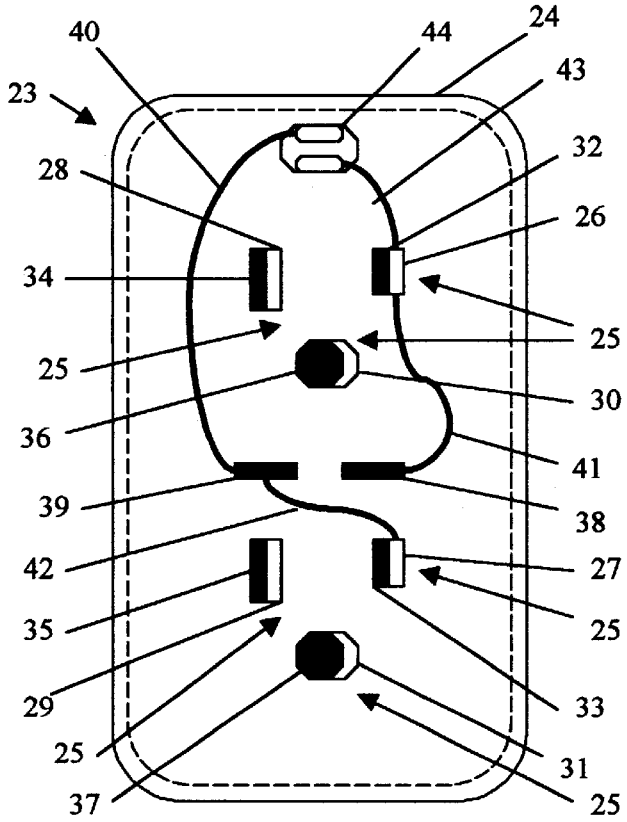
FIG. 2 is a plan view partly in schematic of an adapter in accordance with the preferred embodiment of the present invention.
Figure 3:
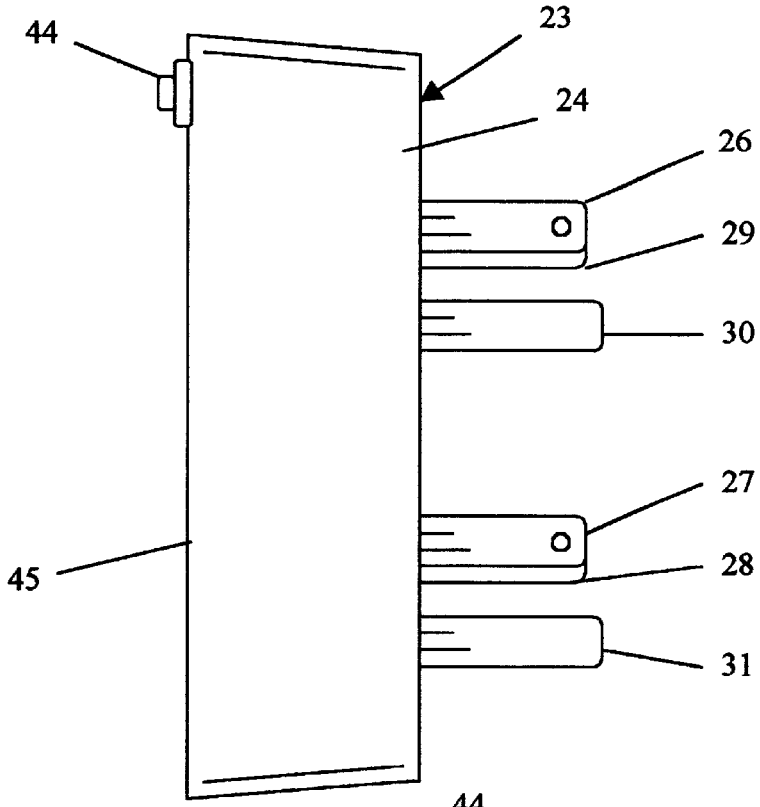
FIG. 3 is a side view of the adapter of FIG. 2.

Referring to FIG. 2, a preferred embodiment of the adapter of the invention is depicted. The adapter generally designated 23 comprises an insulated housing 24 on non-conductive plastic, preferably of phenolic resin conforming to CSA specifications for 240 volts and 3000 watts. The moulded housing 24 is of generally rectangular box like hollow configuration constituted to hold the electrically operative elements in rigid configuration, and can be either two-part construction or unitary. Prongs or blades generally indicated at 25 project from the face of the housing 24, as indicated in FIG. 3, to register with the connectors of the outlet 10, FIG. 1, as will now be described.

Referring again to FIG. 2, the prongs 25 includes power prongs 26 and 27 are connected solidly to female connectors 32 and 33 and electrically via leads 41 and 42 to female connectors 38 and 39 of adapter 23 and aligned on the face of the housing 24 with the hot connectors 15 and 16 respectively of FIG. 1.

Neutral prongs 28 and 29 are similarly aligned on the housing 24 to register with neutral female connectors 18 and 19 FIG. 1, and are solidly connected to female connectors 34 and 35 of adapter 23, FIG. 2. Ground prongs 30 and 31, normally round or u-ground type, are positioned centrally of the housing 24 and aligned with ground female connectors 20 and 21, FIG. 1, and are solidly connected to female connectors 36 and 37 of adapter 23, FIG. 2.

The prongs or blades 25 are normally formed of brass or other conducting metal, and extend through the face of the housing 24, FIG. 2 into the housing interior and connect solidly to corresponding female connectors 32, 33, 34, 35, 36 and 37 that are also formed of brass or other conducting metal and are designed to accept and hold through friction other prongs or blades of cord sets attached to appliances. Female connectors 38 and 39 are similarly fashioned and are connected electrically with soldered or continuous brass/conductive metal strips 41 and 42, to power prongs 26 and 27.

Referring further to FIGS. 2 and 3, an indicator light 44 is included and electrically connected through electrical leads or brass/conductive metal strips 40, 41 and 43 across power prongs 26 and 27, FIG. 2, and will be mounted rigidly on the back surface 45 of housing 24, FIG. 3. The indicator light will accommodate 250 volts, as the maximum voltage potential between two halves of the split voltage supplied to the adapter.

Figure 4:
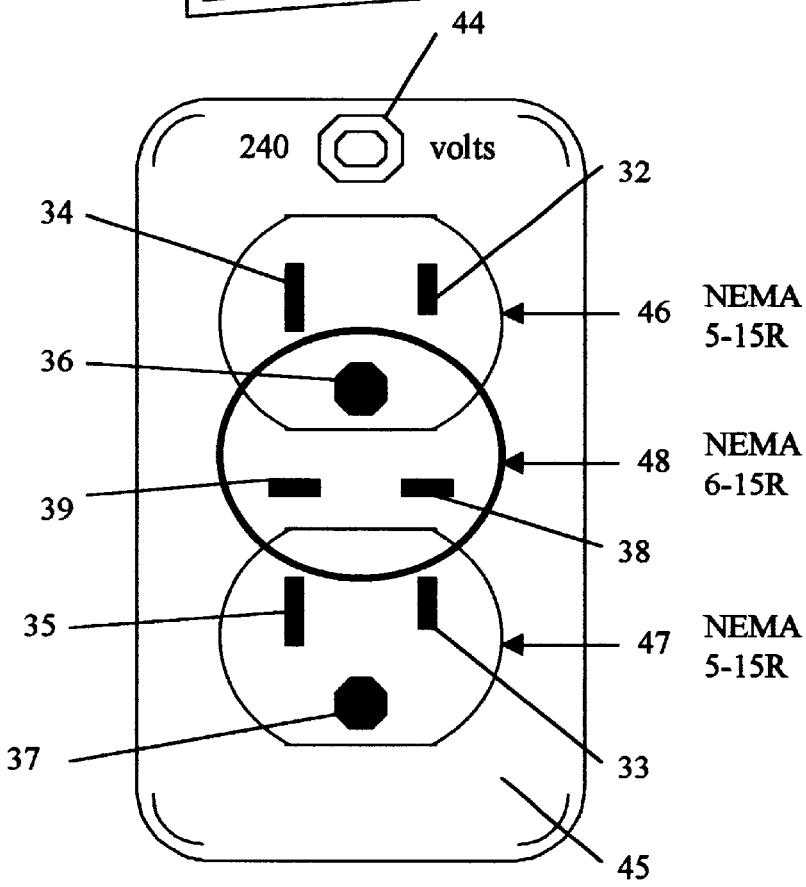
FIG. 4 is a plan view depicting the housing of the adapter of FIG. 2.

Referring to FIG. 4, the back surface 45 of the housing 24 is illustrated with openings through the housing 24 to coincide with all female connectors 32, 33, 34, 35, 36, 37, 38, and 39 and are grouped into three North American standardised outlet configurations, two 120 volt 15 amp NEMA 5-15R outlets 46 and 47 are positioned as per a standard common duplex receptacle illustrated in FIG. 1 and one 240 volt 15 amp NEMA 6-15R outlet, 48 is positioned between the other two outlets to purposely share the ground female connector 36.

In operation:

(1) with the adapter inserted into a split/multiple circuit duplex receptacle the indicator light 44 will respond to visually indicate that a split/multiple circuit receptacle has been utilised and either a single 240 volt 15 amp circuit is available for use or two 120 volt 15 amp circuits are available. With a 240 volt 15 amp NEMA 6-15P plug of an appliance inserted into the 240 volt 15 amp NEMA 6-15R outlet, both of the 120 volt 15 amp NEMA 5-15R outlets will be blocked from use.

(2) with the adapter inserted into a single circuit duplex receptacle, the indicator light 44 will not respond and indicate that only a single circuit receptacle has been utilised and only one 120 volt circuit is available for use.

The foregoing system offers the following improvements and advantages:

(1) with the adapter inserted into a split/multiple circuit duplex wall receptacle on a permanent basis, both the existing two 120 volt 15 amp NEMA 5-15R outlets of the wall receptacle will continue to be available for use with 120 volt appliances. The 240 volt 15 amp NEMA 6-15R outlet will be available for 240 volt appliances only when both NEMA 5-15R outlets are not in use, thus preventing an overload on the split/multiple circuit.

(2) with the adapter inserted into a single circuit duplex receptacle and a 240 volt 15 amp plug is inserted into the NEMA 6-15R outlet of the adapter, no electrical potential will exist between the electrical connectors and no under voltage damage will occur to an appliance.

(3) the maximum power limitation of 1500 watts for all North American kitchen countertop appliances can now be increased to 3000 watts with a significant improvement in operation of a number of previously under powered appliances.

The present invention is not limited to the specific embodiments disclosed by way of example. It will be understood that the scope of the invention is only limited as defined in the appended claims.

What I claim is:

1. An electrical adapter assembly for use in combination with a split circuit duplex receptacle having a first pair of connectors one of which is a hot connector connected to a hot wire lead and is at a voltage potential, and one of which is a neutral connector connected to a neutral lead, and a second pair of connectors at potentials equal to said first pair of connectors 180 degrees out-of-phase therewith, each of said pair of connectors having a grounding connector in conjunction therewith, said adapter assembly comprising in combination:

an electrically insulated adapter housing having a face and a back surface;

a first power prong and a first neutral prong extending outwardly from said face, configured so that said first power prong registers with said hot connector of said first pair of connectors of said duplex receptacle;

a second power prong and a second neutral prong extending outwardly from said face, configured so that said second power prong registers with said hot connector of said second pair of connectors of said duplex receptacle;

a ground prong extending outwardly from said face to register with a grounding connector of said duplex receptacle;

a first configuration of female connectors that is configured to receive a three-pronged NEMA 6-15P plug and extends inwardly from said back surface, said back surface having openings aligned to coincide with said first configuration of female connectors, said first configuration of female connectors consisting of a first hot female connector that is electrically connected to said first power prong, a second hot female connector that is electrically connected to said second power prong, and a ground female connector that is electrically connected to said ground prong, and a second configuration of female connectors that is configured to receive a three-pronged NEMA 5-15P plug and extends inwardly from said back surface, said back surface having openings aligned to coincide with said second configuration of female connectors, said second configuration of female connectors consisting of a hot female connector that is electrically connected to said first power prong, a neutral female connector that is electrically connected to said first neutral prong, and a ground female connector that is electrically connected to said ground prong, wherein the ground female connector of the first configuration of female, connectors is the ground female connector of the second configuration of female connectors, thereby providing both a single 240 volt 15 amp NEMA 6-15R outlet and at least one 120 volt 15 amp NEMA 5-15R outlet configured so that both a NEMA 6-15P plug and a NEMA 5-15P plug cannot be received at the same time by the adapter assembly.

2. An adapter assembly in accordance with claim 1, additionally comprising visual indication means for distinguishing between split and single circuit duplex receptacles.

3. The adapter assembly in accordance with claim 2 in which said indication means comprises an indicator light mounted on said adapter housing electrically connected between said two prong members registering with said hot wires of said duplex outlet.

4. The adapter assembly defined in claim 1, additionally comprising:

a third configuration of female connectors that is configured to receive a three-pronged NEMA 5-15P plug and extends inwardly from said back surface, said back surface having openings aligned to coincide with said third configuration of female connectors, said third configuration of female connectors consisting of a hot female connector that is electrically connected to said second power prong, a neutral female connector that is electrically connected to said second neutral prong, and a ground female connector that is electrically connected to said ground prong.

5. An adapter assembly in accordance with claim 4, wherein the first configuration of female connectors configured to receive a three pronged NEMA 6-15P plug and the third configuration of female connectors configured to receive a three pronged NEMA 5-15P plug overlap so that plugs of both types cannot be received at the same time by the adapter assembly, thereby providing a single 240 volt 15 amp NEMA 6-15R outlet and two 120 volt 15 amp NEMA 5-15R outlets configured so that the NEMA 6-15P plug and any other NEMA 5-15P plug cannot be received at the same time by the adapter assembly.

6. An adapter assembly in accordance with claim 5, additionally comprising visual indication means for distinguishing between split and single circuit duplex receptacles.

7. The adapter assembly in accordance with claim 6 in which said indication means comprises an indicator light mounted on said adapter housing electrically connected between said two prong members registering with said hot wires of said duplex outlet.

8. An electrical adapter assembly for use in combination with a split circuit duplex receptacle having a first pair of connectors one of which is a hot connector connected to a hot wire lead and is at a voltage potential, and one of which is a neutral connector connected to a neutral lead, and a second pair of connectors at potentials equal to said first pair of connectors 180 degrees out-of-phase therewith, each of said pair of connectors having a grounding connector in conjunction therewith, said adapter assembly comprising in combination:

an electrically insulated adapter housing having a face and a back surface;

a first power prong and a first neutral prong extending outwardly from said face, configured so that said first power prong registers with said hot connector of said first pair of connectors of said duplex receptacle;

a second power prong and a second neutral prong extending outwardly from said face, configured so that said second power prong registers with said hot connector of said second pair of connectors of said duplex receptacle;

a ground prong extending outwardly from said face to register with a grounding connector of said duplex receptacle;

a first configuration of female connectors that is configured to receive a three-pronged NEMA 6-15P plug and extends inwardly from said back surface, said back surface having openings aligned to coincide with said first configuration of female connectors, said first configuration of female connectors consisting of a first hot female connector that is electrically connected to said first power prong, a second hot female connector that is electrically connected to said second power prong, and a ground female connector that is electrically connected to said ground prong, and a second configuration of female connectors that is configured to receive a three-pronged NEMA 5-15P plug and extends inwardly from said back surface, said back surface having openings aligned to coincide with said second configuration of female connectors, said second configuration of female connectors consisting of a hot female connector that is electrically connected to said first power prong, a neutral female connector that is electrically connected to said first neutral prong, and a ground female connector that is electrically connected to said ground prong, wherein the ground female connector of the second configuration of female, connectors is different from the ground female connector of the first configuration of female connectors, and wherein the first configuration of female connectors configured to receive a three pronged NEMA 6-15P plug and the second configuration of female connectors configured to receive a three pronged NEMA 5-15P plug overlap so that plugs of both types cannot be received at the same time by the adapter assembly, thereby providing both a single 240 volt 15 amp NEMA 6-15R outlet and at least one 120 volt 15 amp NEMA 5-15R outlet configured so that both a NEMA 6-15P plug and a NEMA 5-15P plug cannot be received at the same time by the adapter assembly.

9. An adapter assembly in accordance with claim 8, additionally comprising visual indication means for distinguishing between split and single circuit duplex receptacles.

10. The adapter assembly in accordance with claim 9 in which said indication means comprises an indicator light mounted on said adapter housing electrically connected between said two prong members registering with said hot wires of said duplex outlet.

* * * * *